US006158850A

United States Patent [19]

Cook

[11] Patent Number: 6,158,850

[45] Date of Patent: Dec. 12, 2000

[54] ON CARRIER SECONDARY INK TANK WITH MEMORY AND FLOW CONTROL MEANS

[75] Inventor: William Paul Cook, Lexington, Ky.

[73] Assignee: Lexmark International, Inc., Lexington, Ky.

[21] Appl. No.: 09/100,484

[22] Filed: Jun. 19, 1998

[51] Int. Cl.[7] ..... B41J 29/393; B41J 2/175

[52] U.S. Cl. ..... 347/85; 347/19

[58] Field of Search ..... 347/84–87, 19, 347/49; 399/238, 258, 260, 27, 12, 25

[56] References Cited

U.S. PATENT DOCUMENTS

| | | | |
|---|---|---|---|
| Re. 36,279 | 8/1998 | Ujita . | |
| 4,399,446 | 8/1983 | McCann et al. . | |
| 4,432,005 | 2/1984 | Duffield et al. . | |
| 4,437,104 | 3/1984 | Hudson . | |
| 4,811,035 | 3/1989 | Huliba et al. . | |
| 4,878,069 | 10/1989 | Kiyohara . | |
| 4,961,088 | 10/1990 | Gilliland et al. | 399/25 |
| 5,162,817 | 11/1992 | Tajika et al. | 347/86 |
| 5,367,328 | 11/1994 | Erickson . | |
| 5,491,540 | 2/1996 | Hirst . | |
| 5,504,507 | 4/1996 | Watrobski et al. . | |
| 5,506,611 | 4/1996 | Ujita et al. . | |
| 5,515,091 | 5/1996 | Kimura et al. . | |
| 5,534,899 | 7/1996 | Uchikata et al. . | |
| 5,610,635 | 3/1997 | Murray et al. . | |
| 5,619,237 | 4/1997 | Inoue et al. . | |
| 5,619,239 | 4/1997 | Kotaki et al. . | |
| 5,686,947 | 11/1997 | Murray et al. . | |
| 5,694,156 | 12/1997 | Hoisington et al. | 347/7 |
| 5,699,091 | 12/1997 | Bullock et al. . | |
| 5,788,388 | 8/1998 | Cowger et al. . | |

FOREIGN PATENT DOCUMENTS

| | | |
|---|---|---|
| 5-96744 | 4/1993 | Japan . |

*Primary Examiner*—N. Le
*Assistant Examiner*—Judy Nguyen
*Attorney, Agent, or Firm*—Michael T. Sanderson; Luedeka, Neely & Graham

[57] ABSTRACT

An apparatus and method insures that the ink supply in a disposable on carrier secondary ink tank and the ink supply in a semi-permanent base cartridge are compatible before a refilling operation is allowed to occur for an ink jet printer cartridge. A first memory is located in the base cartridge assembly and a second memory is located in the secondary ink tank. Compatibility information concerning properties such as the type, color and formulation of the ink supplies in the base cartridge assembly and secondary ink tank is saved in the first and second memories. Before a refilling operation is commenced, the compatibility information is examined to determine if the ink supplies in the secondary ink tank and base cartridge assembly are compatible. If the ink supplies are compatible, a flow control device is activated to allow the refilling operation to begin. If the ink supplies are incompatible, the flow control device prevents the ink supplies from mixing and an alarm is produced that informs the user of the printer that the ink supplies are incompatible. The first and second memories are also employed to limit a base cartridge assembly to being refilled with secondary ink tanks belonging to a certain set of secondary ink tanks. The methods and apparatus described in the specification enable continued high quality printing for the life of the printhead.

31 Claims, 9 Drawing Sheets

| Fig. 5A | |
|---|---|
| | Fig. 5B |

ON CARRIER SECONDARY INK TANK WITH MEMORY AND FLOW CONTROL MEANS

FIELD OF THE INVENTION

The invention provides a method and apparatus for insuring the primary ink supply in a print cartridge is properly matched with a secondary, on carrier ink reservoir. More particularly, it relates to an ink jet printer that saves compatibility information in memories on a primary base cartridge assembly and an on carrier secondary ink tank. Based on the compatibility information, the ink jet printer either prevents or enables the flow of ink between the primary and the secondary ink supplies by sending flow control signals to a flow control device.

BACKGROUND OF THE INVENTION

Ink jet type printers employ a print head that consists of a reservoir of ink and a semiconductor chip containing ink energizing elements such as resistance heaters or piezoelectric devices. The chip is attached to a nozzle plate having a series of nozzles that expel ink from the reservoir onto a printing surface. In a thermal ink jet printer, the ink is expelled by superheating a small portion of the ink with an electric nozzle resistor located in a chamber beneath the nozzle. The boiling ink forms an expanding bubble that propels a drop of ink through the nozzle and onto the printing surface. By carefully controlling the expulsion of the ink through the nozzles and onto the printing surface, a high quality image can be created. In a printhead using piezoelectric devices as the energizing elements, ink discharge pressure is generated by mechanical displacement or vibration of the piezoelectric devices. For color printing applications, the three primary colors of cyan, magenta and yellow are provided by ejecting ink through nozzles or holes associated with an inkwell or print head containing each of the primary colors.

Due to the small amount of ink that can be stored in an ink jet print head cartridge and the limited life span of the semiconductor chip, print head cartridges are generally designed to be disposable. However, most print head cartridges used in ink jet printers today contain much less ink than the semiconductor chip is capable of expelling through its nozzles. Thus, the chip is still usable after the initial ink supply has been expended.

Various schemes have been proposed to supply ink to the print head cartridge to extend its useful life and reduce the cost of printing. For example, some ink jet printers employ a siphon connection between the primary print head cartridge ink reservoir and a remote secondary ink reservoir. As the primary ink reservoir empties, additional ink is siphoned from the secondary ink reservoir into the primary reservoir. Another approach is to use semi-permanent print head cartridges with replaceable on carrier ink reservoirs. When the print head cartridge runs out of ink, the old ink reservoir is discarded and a new ink reservoir is attached to the print head. The idea is to make better use of the expensive semiconductor chips and nozzle plates and, thus, lower the cost of printing with an ink jet printer.

The use of semi-permanent print heads with replaceable ink reservoirs may cause problems. For example, if the primary print head ink reservoir and secondary replaceable ink reservoir are not permanently connected, they may become separated and be improperly reconnected to an incompatible component. The primary print head ink reservoirs may not be compatible with the secondary ink reservoirs for a variety of reasons. For example, the colors of the inks may be different. If a secondary ink reservoir containing a blue ink is attached to a primary ink reservoir containing a yellow ink, the blue ink may mix with the yellow ink and render the ink unusable for color printing applications.

Mechanical features have been added to the primary and secondary ink reservoirs that make it impossible to connect a secondary ink reservoir to an incompatible primary ink reservoir. However, as the number of colors, dye formulations, and special requirements increases, the mechanical systems have become inadequate to cover all the possible combinations. Thus, matching the primary ink reservoir with the secondary ink reservoir has become a substantial problem.

Therefore, there is a need for an efficient, inexpensive method and apparatus for insuring that the attributes of the ink contained in a secondary on carrier ink reservoir are compatibly matched with the attributes of the ink in a primary ink reservoir. In addition, the invention should be able to prevent the ink of an incompatible cartridge from mixing with the ink of the primary cartridge.

SUMMARY OF THE INVENTION

With regard to the above and other advantages, the present invention provides an improved print head cartridge system for an ink jet printer. The improved print head cartridge system insures that the ink supply in a disposable secondary ink tank is properly matched with the ink supply in a semi-permanent base cartridge assembly.

A preferred embodiment of the print head cartridge system has a disposable secondary ink tank that is designed to be mounted on a semi-permanent base cartridge assembly. The base cartridge assembly includes a base ink reservoir for storing a primary ink supply. A memory in the base cartridge assembly stores information concerning properties of the primary ink supply in the base ink reservoir. A semiconductor chip located on the base cartridge assembly is attached to a nozzle plate containing a series of nozzles for expelling drops of ink from the primary ink supply onto a printing surface. Ink is provided from the base ink reservoir to a series of energizing devices on the semiconductor chip by a stand pipe. An ink passage receives ink from a secondary ink tank mounted on the base cartridge assembly and provides the ink to the base ink reservoir. As ink flows into the base ink reservoir from the secondary ink reservoir, an air supply passage provides a path for air to flow from the base ink reservoir into the secondary ink reservoir.

The flow of ink from the secondary ink reservoir is controlled by a pinch valve that is attached to a solenoid. When the solenoid engages the pinch valve, the ink passage and the air supply passage are blocked so that no ink or air can flow between the base cartridge assembly and the secondary ink tank. A sensor is employed to sense the amount of ink remaining in the primary base ink reservoir. In addition, a microprocessor calculates the amount of ink expelled from the primary base ink reservoir by counting the number of ink drops expelled from the nozzles.

The secondary ink tank is designed to be mounted on the base cartridge assembly and contains a secondary ink supply. A memory in the secondary ink tank stores information concerning the secondary ink supply in the secondary ink reservoir. An electrical interface is provided between the base cartridge assembly, secondary ink tank and ink jet printer that enables the ink jet printer to control the functioning of the pinch valve and access the information stored in the memories of the base cartridge assembly and the secondary ink tank.

By examining the compatibility information stored in the memories of the secondary ink tank and the base cartridge assembly, the printer electronics can determine if the secondary ink supply is compatible with the primary ink supply. If the supplies are compatible, the printer electronics disengage the pinch valve and allow the secondary ink supply to flow into the base ink reservoir. If the ink supplies are incompatible, the printer electronics use the pinch valve to block the secondary ink supply from mixing with the primary ink supply and alert the user of the printer that an improper secondary ink tank has been installed on the base cartridge assembly.

The above described embodiment significantly improves the prior art by providing a device that insures the ink supply in the disposable secondary ink tank is compatible with the primary ink supply in the base cartridge assembly. The provision of a memory on the secondary ink tank and base cartridge assembly is an improvement over prior art mechanical systems for insuring compatibility because the memory allows an increased amount of variations of ink colors, types and formulations to be taken into account. Furthermore, the memory is used to store additional information such as ink consumption and supply data, spectral analysis of the ink color, manufacturing data, and heater chip parameters.

In an alternative embodiment, an identification code is stored on each secondary ink tank in a set of secondary ink tanks that identifies each of the secondary ink tanks as belonging to the set of secondary ink tanks. The identification code from the first secondary ink tank installed in the base cartridge assembly is read by the printer electronics and then stored in a memory on the base cartridge assembly. The base cartridge assembly is then only refilled with ink from a secondary ink tank if the secondary ink tank has an identification code that matches the identification code stored in the memory of the base cartridge assembly and, thus, belongs to the same set of secondary ink tanks as the first secondary ink tank installed in the base cartridge assembly.

Forcing a base cartridge assembly to only be used with a limited number of secondary ink tanks belonging to a set of compatible secondary ink tanks provides a number of advantages over the prior art. First, it insures that an incompatible secondary ink supply will not be mixed with the primary ink supply in the base cartridge assembly. Secondly, it limits the number of times a user can refill the base cartridge assembly. Typically, the printhead containing ink energizing devices and a nozzle plate attached to an ink jet cartridge will last longer than the ink supply contained in the cartridge. However, the life of the printhead is not unlimited and continuing to print with a cartridge that has disabled nozzles will significantly degrade the print quality. By limiting the number of times a secondary ink tank can be used to refill the base cartridge assembly, the present invention insures acceptable print quality.

The present invention also provides a method of preventing an on carrier secondary ink tank from refilling an incompatible base cartridge assembly. In accordance with the method, compatibility information concerning properties of the secondary ink supply in a secondary ink tank is stored in a memory on the secondary ink tank and compatibility information concerning properties of the primary ink supply in a base cartridge assembly is stored in a memory on the base cartridge assembly. An electrical interface is provided that allows communication of the compatibility information between the printer electronics, the base cartridge assembly and the secondary ink tank. The compatibility information is communicated from the base cartridge assembly and the secondary ink tank to the printer electronics. The compatibility information stored on the secondary ink tank is analyzed and compared with the compatibility information stored on the base cartridge assembly to determine if the secondary ink supply is compatible with the primary ink supply. An incorrect installation alarm is produced if the compatibility information received through the electrical interface indicates either an open or a short circuit. This alarm informs the user that the secondary ink tank has been improperly installed on the base cartridge assembly.

Once the compatibility information has been analyzed, the flow of ink between the base cartridge assembly and the secondary ink tank is controlled by sending control signals to a flow control device located between the base cartridge assembly and the secondary ink tank. The control signals to the flow control device prevent the secondary ink tank from refilling the base cartridge assembly with ink if the primary and secondary ink supplies are incompatible. In addition, an incompatible secondary ink supply alarm is produced if the primary and secondary ink supplies are incompatible. However, if it has been determined that the primary and secondary ink supplies are compatible, control signals are sent to the flow control device that enable the secondary ink tank to refill the base cartridge assembly. Thus, incompatible ink supplies are prevented from deleteriously mixing.

Several other improvements are also practiced in accordance with the preferred method. For example, in order to reduce ink spillage or inadvertent ink mixing, the ink flow control is automatically disabled when power is off, when the printhead base assembly is removed from the printer and when the secondary ink tank is separated from base assembly. In an alternate embodiment, the ink consumption of the base cartridge assembly is sensed or calculated and provided to the printer electronics through the electrical interface. This ink consumption information is stored in the memory of the base cartridge assembly and used to detect refilling system and sensor failures.

Yet another improvement relates to comparing the compatibility information from a first base cartridge assembly and secondary ink tank pair installed in a printer having multiple base cartridge assembly and secondary ink tank pairs to the compatibility information from at least one other base cartridge assembly and secondary ink tank pair to determine if the first base cartridge assembly and secondary ink tank pair will properly function with the other base cartridge and secondary ink tank pair as part of a printing system.

An alternative method of practicing the present invention involves storing an identification code on each secondary ink tank in a set of secondary ink tanks that identifies each secondary ink tank as belonging to the set of secondary ink tanks. The identification code from the first secondary ink tank installed in a base cartridge assembly is read and stored in a memory on the base cartridge assembly. Once the identification code is stored in the memory on the base cartridge assembly, the base cartridge assembly is only refilled with ink from a secondary ink tank if the secondary ink tank has an identification code that matches the identification code stored in the memory of the base cartridge assembly and, thus, belongs to the same set of secondary ink tanks as the first secondary ink tank installed in the base cartridge assembly. This allows the number of refilling operations to be limited to the number of secondary ink tanks in the set. Thus, the prior art problems associated with over use of the base cartridge assembly are avoided.

As can be seen from the above discussion, the present invention provides many benefits over the prior art. By providing a device and method for preventing secondary ink supplies from refilling a base cartridge assembly with incompatible ink, the invention eliminates costly installation mistakes. Furthermore, the provision of a memory on the base cartridge assembly and the secondary ink tanks allows useful additional information such as ink consumption and manufacturing data to be stored on the devices. Thus, the present invention is a significant improvement over the prior art.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1:
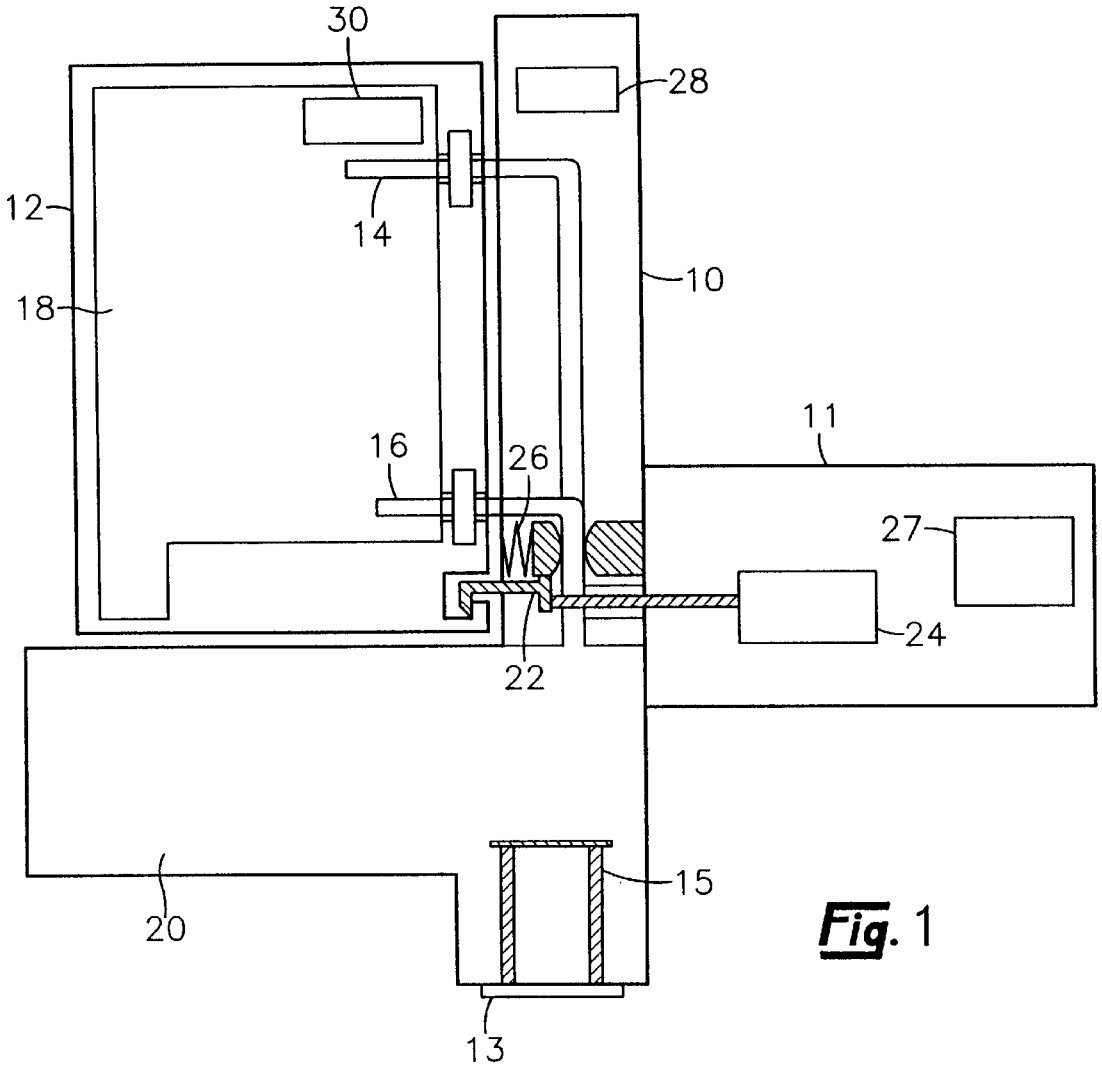
FIG. 1 is a pictorial representation of the present invention with the solenoid located in the printer.

With reference now to FIG. 1, there is shown a pictorial representation of an apparatus for preventing a user from refilling a base cartridge assembly 10 with ink from an incompatible secondary ink tank 12. The base cartridge assembly 10 is designed to be mounted on a print head carrier of an ink jet printer 11. The base cartridge assembly 10 has a printhead 13 that contains a semiconductor chip and a nozzle plate attached to the chip containing a series of nozzles that are used to expel drops of ink onto a printing surface. When the ink jet printer 11 is printing, the print head carrier moves the base cartridge assembly 10 back and forth across a printing surface. By controlling the timing of the firing of the energizing devices on the printhead 13, an image is created on the printing surface.

Ink is provided to the semiconductor chip of the printhead 13 by a stand pipe 15 which receives the ink from a base ink reservoir 20. As the nozzles on the printhead 13 continue to expel ink during printing operations, the supply of ink in the base ink reservoir 20 is steadily depleted. Because the supply of ink contained in the base ink reservoir 20 will be exhausted before the useful life of the nozzle plate and energizing devices on the printhead 13 has expired, it is beneficial to refill the base ink reservoir 20 with a new supply of ink.

Thus, a secondary ink tank 12 is designed to be mounted on the base cartridge assembly 10 so that an air passage 14 and an ink passage 16 are provided from a secondary ink reservoir 18 to the base ink reservoir 20. The ink passage 16 provides a path for ink to flow from the secondary ink reservoir 18 to the base ink reservoir 20. As the ink flows into the base ink reservoir 20, air flows through the air passage 14 into the secondary ink reservoir 18.

To insure that incompatible inks are not mixed, the ink supply in the secondary ink reservoir 18 must be checked to see if it is compatible with the ink supply in the base ink reservoir 20 before it is permitted to mix with the ink from the base ink reservoir 20. To prevent the ink supply in the secondary ink reservoir 18 from mixing with the ink supply in the base ink reservoir 20, a pinch valve 22 is provided that prevents ink from flowing through the ink passage 16. The pinch valve 22 is mechanically connected to a solenoid 24 and a spring 26. The spring 26 biases the pinch valve 22 such that when the solenoid 24 is not activated or the secondary ink tank 12 is removed from the base cartridge assembly 10, the spring 26 forces the pinch valve 22 to squeeze the ink passage 16 and air supply passage 14 with sufficient force to prevent the ink supply in the secondary ink reservoir 18 from mixing with the ink supply in the base ink reservoir 20. Conversely, when the solenoid 24 is activated, it forces the pinch valve 22 to open and, thus, permits ink to flow from the secondary ink reservoir 18 into the base ink reservoir 20.

The solenoid 24 is controlled by the printer electronics 27 of the ink jet printer 11. In order to determine whether or not to activate the solenoid 24 and enable the refilling operation, the printer electronics 27 examine compatibility information stored on memories 28 and 30 in the base cartridge assembly 10 and secondary ink tank 12. This information is obtained by the printer electronics 27 through an electrical interface between the printer electronics 27 and a first memory 28 in the base cartridge assembly 10 and a second memory 30 in the secondary ink tank 12. The electrical interface consist of electrical connections between the memories 28 and 30 and the printer electronics 27 that allow the printer electronics 27 to request and receive the compatibility information from the memories 28 and 30.

In the simplest embodiment of this invention, both memories 28 and 30 are read only memory (ROM) devices which are programmed as part of the manufacturing process (PROM), or permanently encoded when the device is originally produced (mask ROM). In another embodiment, the memories 28 and 30 contain non-volatile random access memory (NVRAM) such as flash or EEPROM memory. The use of random access memory allows information to be stored and read from the memories 28 and 30 by the printer electronics 27. It is understood that the memories 28 and 30 do not necessarily contain the same type of memory. For example, an alternative technique for providing the base cartridge memory 28 is to use memory locations in the semiconductor chip on the printhead 13 to hold the compatibility information.

In an alternate embodiment, the pinch valve 22 and the solenoid 24 are replaced with a piezoelectric device. Sending an electric signal to the piezoelectric device causes the device to expand and compress a spring 26 attached to one side of the pinch valve 22. The expansion opens the air supply passage 14 and ink passage 16. Upon removal of the electric signal, the spring 26 applies a force sufficient to urge the pinch valve 22 closed and thus prevent the ink supply in the secondary ink reservoir 18 from mixing with the ink supply in the base ink reservoir 20. Thus, the piezoelectric device operates in fashion very similar to the pinch valve 22 and solenoid combination 24.

The compatibility information contained in the memories 28 and 30 can be examined by the printer electronics 27 to determine if the primary ink supply in the base cartridge reservoir 20 is compatible with the secondary ink supply in the secondary ink reservoir 18. In a preferred embodiment, the compatibility information consists of an identification code. The printer electronics 27 read and compare the identification codes from the memories 28 and 30. If the codes are identical, the ink supplies in the base 20 and secondary ink reservoirs 18 are compatible and, the printer electronics 27 activate the solenoid 24 and initiate the refilling operation. If the codes are not identical, the printer electronics 27 do not activate the solenoid 24 and the pinch valve 22 remains closed and prevents the ink supplies from mixing.

Some non-identical inks are compatible. Thus, in an alternate embodiment, the compatibility information is digitally encoded data that contains information about the ink in either the base ink reservoir 20 or secondary ink reservoir 18. This information is decoded by the printer electronics 27. The decoded information contains details concerning which types of ink colors and formulations are compatible with the ink supply in the respective ink reservoir 18 or 20. Thus, the invention allows the printer electronics 27 to recognize non-identical ink formulations that are nevertheless compatible.

Ink supplies may be incompatible for a number of different reasons such as different ink types, colors or dye formulations. Some prior art printing systems add mechanical features to one or both of the secondary ink tank 12 and base cartridge assembly 10 that prevent incompatible ink supplies from being mixed. However, because of the large number of different inks, these mechanical systems quickly become inadequate to cover all combinations. By providing memories 28 and 30, the amount of information that can be used to determine compatibility is greatly increased in the present invention.

In an alternate embodiment of the present invention, an additional amount of set information is stored on the memory 30 in the secondary ink tank 12 that identifies the secondary ink tank 12 as belonging to a set of secondary ink tanks. When the first compatible secondary ink tank 12 is installed on a base cartridge assembly 10, the set information corresponding to the set of secondary ink tanks is read by the printer electronics 27 and stored on the memory 28 in the base cartridge assembly 10. The printer electronics 27 then check the memories 30 of any subsequent secondary ink tanks 12 installed on the base cartridge assembly 10 to determine if they are from the same set as the first compatible secondary ink tank 12 installed on the base cartridge assembly 10. If the set information in the memory 30 in the secondary ink tank 12 indicates the secondary ink tank 12 belongs to the same set of secondary ink tanks as the first compatible secondary ink tank 12, the printer electronics 27 send flow control signals to the solenoid 24 that disengage the pinch valve 22 and allow the secondary ink reservoir 18 to refill the base ink reservoir 20. If the secondary ink tank 12 is not from the same set of secondary ink tanks as the first compatible secondary ink tank 12 installed on the base cartridge assembly 10, the printer electronics 27 engage the pinch valve 22 and prevent the secondary ink reservoir 18 from refilling the base ink reservoir 20.

By limiting a base cartridge assembly 10 to use with a particular set of secondary ink tanks 12, users of a printer are prevented from refilling the base cartridge assembly 10 past the useful life of the nozzles on the heater chip 13.

Figure 2:
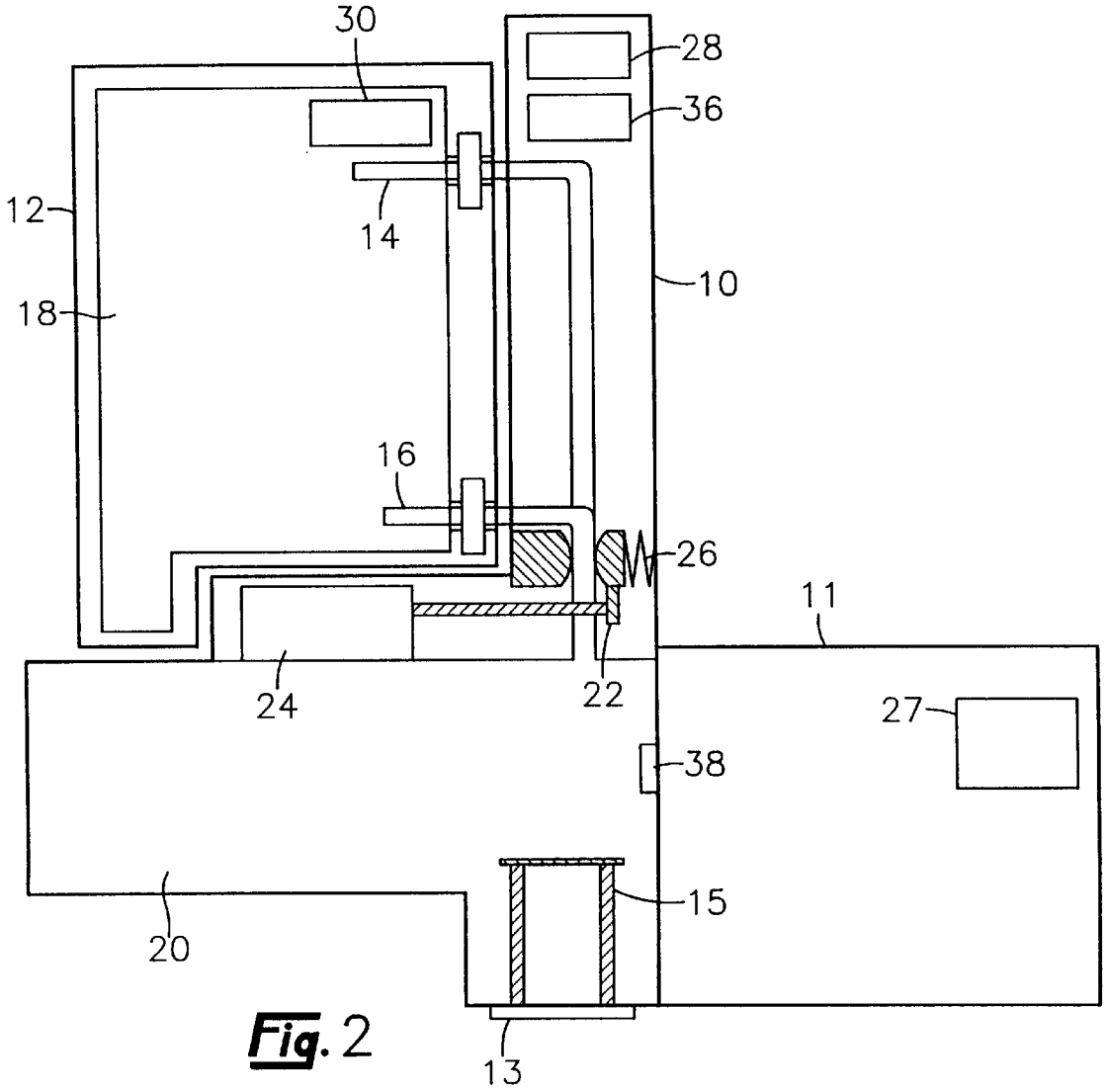
FIG. 2 is a pictorial representation of the present invention with the solenoid included as part of the base cartridge assembly.

Referring now to FIG. 2, another embodiment of the present invention is shown. The embodiment consist of a semi-permanent base cartridge assembly 10 with a disposable secondary ink tank 12 mounted on top. An ink supply passage 16 and an air supply passage 14 allow ink from a secondary ink reservoir 18 in the secondary ink tank 12 to refill a base ink reservoir 20 in the base cartridge assembly 10. Unlike the previous embodiment depicted in FIG. 1, the embodiment shown in FIG. 2 has the solenoid 24 built into the base cartridge assembly 10. The solenoid 24 is connected to a pinch valve 22. In its resting position, the pinch valve 22 is spring biased to engage the ink and air supply passages 16 and 14 in a manner that prevents ink from the secondary ink reservoir 18 from entering the base ink reservoir 20.

Ink can only flow from the secondary ink reservoir 18 into the base ink reservoir 20 when the solenoid 24 is engaged. The action of the solenoid 24 is controlled by a microprocessor 36 that is located in the base cartridge assembly 10. The microprocessor 36 has an associated memory 28 that is also located in the base cartridge assembly 10. To determine if the ink supplies in the base ink reservoir 20 and secondary ink reservoir 18 are compatible the microprocessor 36 examines the compatibility information stored in the memory 28. The compatibility information contains a code representing the type of the ink contained in the base ink reservoir 20. In addition, the memory 28 preferably contains a list of all the possible ink types and which types of inks can be compatibly mixed.

An electrical interface is provided whereby the microprocessor 36 is electrically connected to the memory 30 in the second ink tank 12 when the second ink tank 12 is properly mounted on the base cartridge assembly 10. This interface allows the microprocessor 36 to read the compatibility information from a memory 30 in the secondary ink tank 12. Once the microprocessor 36 receives the compatibility information from the memory 30, the information is referenced against the list of compatible inks to determine if the secondary ink reservoir 18 contains an ink supply that is compatible with the primary ink supply in the base cartridge reservoir 20.

If it is determined that the ink supplies are compatible, the microprocessor 36 sends flow control signals to the solenoid 24 which engage the solenoid 24 and allow ink to pass from the secondary ink reservoir 18 through the ink passage 16 into the base ink reservoir 20. If the ink supplies are incompatible, the microprocessor 36 produces an incompatible secondary ink supply signal which is sent to the printer electronics 27. The printer electronics 27 cause the ink jet printer 11 to produce either an audible or visual alarm that indicates to a user of the printer 11 that an incompatible secondary ink tank 12 has been installed on the base cartridge assembly 10.

The provision of a microprocessor 36 also allows a variety of other functions to be performed. For example, in FIG. 2, the microprocessor 36 also has electrical connections to an ink level sensor 38 and the semiconductor device on the printhead 13. These electrical connections to the printhead 13 allow the microprocessor 36 to calculate the ink consumption of the base cartridge assembly 10 by counting the number of times the nozzles on the printhead 13 have been fired. The electrical connections to the ink level sensor 38 allow the microprocessor 36 to receive a signal indicative of the amount of ink in the base ink reservoir 20. By comparing the drop count data concerning the ink consumption of the base cartridge assembly 10 and the sensor data corresponding to the amount of ink remaining in the base cartridge assembly 10, the microprocessor 36 can determine when a refilling operation or an ink level sensor 38 failure has occurred.

Figure 3:
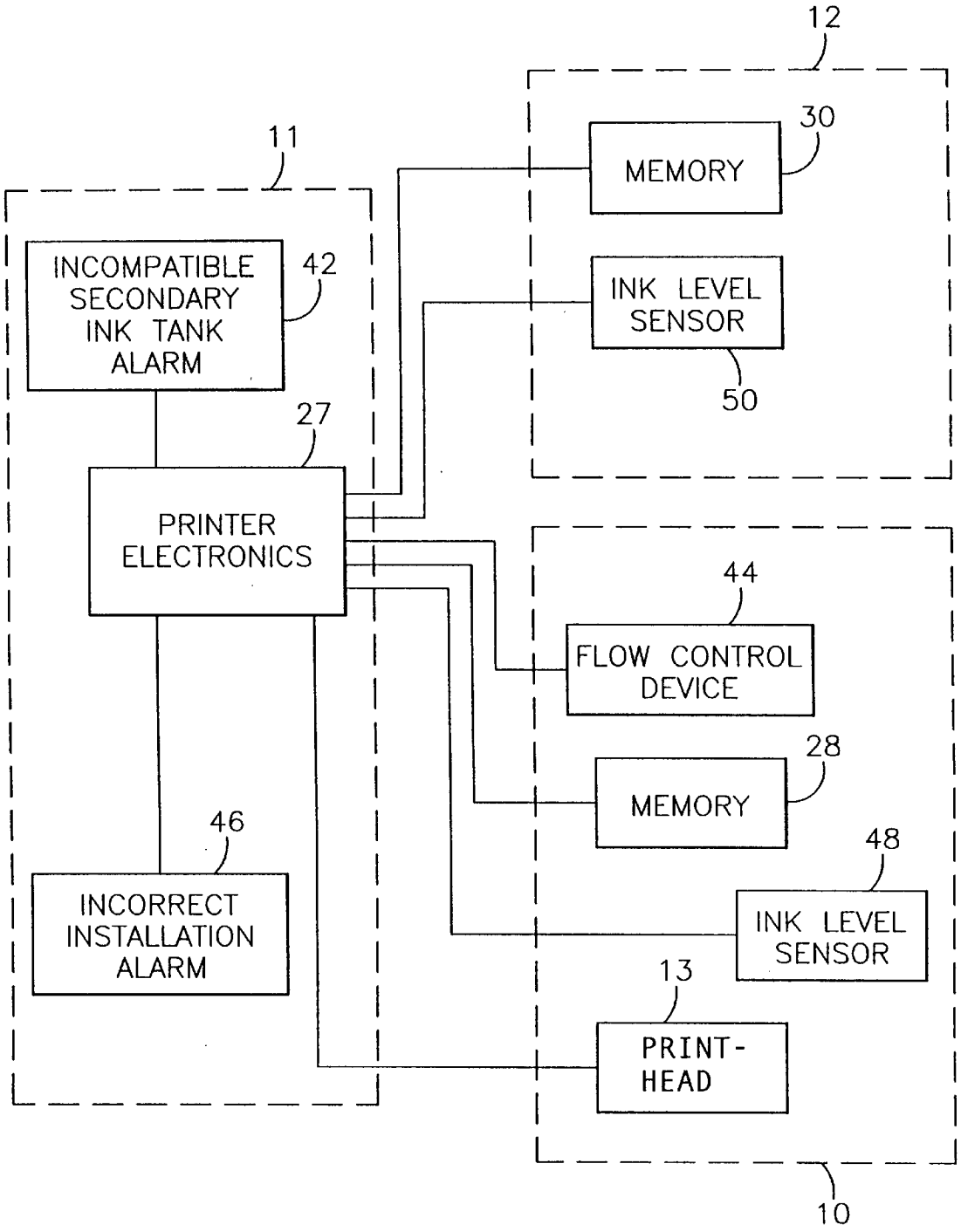
FIG. 3 is a block diagram of the electronics needed to implement an embodiment of the present invention.

Referring now to FIG. 3, a block diagram of the electronics and electrical connections needed to implement an embodiment of the present invention are shown. Control and monitoring of the electronic components of this embodiment are provided by the printer electronics 27 located in the ink jet printer 11. The printer electronics 27 preferably include a microprocessor and a memory. The printer electronics 27 are electrically connected to a memory 28 located in the base cartridge assembly 10. This electrical connection is represented in FIG. 3 as a single solid line. However, it is understood that the single line in FIG. 3 could represent a number of actual conductive wires or lines running from the printer electronics 27 to the base cartridge assembly memory 28. The electrical connections between the printer electronics 27 and the memory 28 allow the printer electronics 27 to read the information stored in the memory 28. The information stored on the memory 28 includes compatibility information that corresponds to the type, color, and formulation of the ink supply contained in the base cartridge assembly 10.

The printer electronics 27 are also electrically connected to a memory 30 in a secondary ink tank 12 that is mounted on the base cartridge assembly 10. The electrical connections allow the printer electronics 27 to read the information stored in the memory 30. The information corresponds to the type, color and formulation of the ink supply contained in the secondary ink tank 12.

Once the printer electronics 27 have read the contents of both memory 28 and memory 30, the contents of the memories 28 and 30 are analyzed and compared to determine if the ink supply in the secondary ink tank 12 is compatible with the ink supply in the base cartridge assembly 10. The printer electronics 27 contain an internal list saved in memory that outlines which particular types of ink are compatible. In an alternative embodiment, the information from the memories 28 and 30 will be identical if the ink supplies are compatible. If the information from the memories 28 and 30 indicates the secondary ink tank 12 and base cartridge assembly 10 are incompatible, the printer electronics 27 produce an incompatible secondary ink tank alarm signal which is sent to an incompatible secondary ink tank alarm 42 that informs a user of the printer 11 that an incompatible secondary ink tank 12 has been installed on the base cartridge assembly 10.

If the printer electronics 27 examine the information on the memories 28 and 30 and determine that the ink supplies in the secondary ink tank 12 and base cartridge assembly 10 are compatible, the printer electronics 27 send flow control signals to a flow control device 44 that enable the secondary ink tank 12 to refill the base cartridge assembly 10. As discussed above, it is understood that the flow control device may be implemented with a variety of valves such as pinch valves, plug valves, gate valves, pintle valves, etc., that are actuated by a variety of means such as piezoelectric transducers, solenoids, hydraulics, motors, etc. Furthermore, in the preferred embodiment, the flow control device 44 is part of the base cartridge assembly 10. However, in alternative embodiments the flow control device 44 is located in the secondary ink tank 12 or the printer 11 itself. Locating the flow control device 44 in the semi-permanent base cartridge assembly 10 is preferred because doing so eliminates the connection problems associated with placing the flow control device 44 in the printer 11 itself and is more cost efficient than placing the flow control device 44 on the disposable secondary ink tank 12.

The existence of memories 28 and 30 on the secondary ink tank 12 and the base cartridge assembly 10 make it possible for the printer electronics 27 to determine if the secondary ink tank 12 and base cartridge assembly 10 are properly installed on the print head carrier of an ink jet printer 11 by accessing the memories 28 and 30. If a set of data can be received from the memories 28 and 30, it can be inferred that the secondary ink tank 12 and base cartridge assembly 10 are properly installed. However, some memory values are preferably considered invalid. For example, a reading of all ones or all zeros indicates either an open or a short circuit. If the information read from either memory 28 or memory 30 consists of all ones or zeros, the printer electronics 27 send an incorrect installation signal to an incorrect installation alarm 46. The incorrect installation alarm 46 informs a user of the printer that either the secondary ink tank 12 or the base cartridge assembly 10 has been incorrectly installed.

The existence of the memories 28 and 30 on the secondary ink tank 12 and base cartridge assembly 10 also allow for a variety of other operations to be performed by the present invention. For example, the printer electronics 27 can track the ink consumption of the printhead 13 in the base cartridge assembly 10 by counting the number of drops expelled from the printhead 13. The consumption information is then stored in the memory 28 on the base cartridge assembly 10. Once the base cartridge assembly 10 has been refilled a certain amount of times and expelled a certain amount of ink, a set of data is stored in the memory 28 that informs the printer electronics 27 not to use the expired base cartridge assembly 10 anymore. Thus, the problems associated with continued use of the base cartridge assembly 10 after the nozzles and ink energizing devices on the printhead 13 have worn out are eliminated by the present invention.

The embodiment shown in FIG. 3 also provides an electrical connection between the printer electronics 27 and a first 48 and a second ink level sensor 50. The ink level sensors 48 and 50 use the electrical resistance or capacitance of the ink inside the secondary ink tank 12 and base cartridge assembly 10 to determine the volume of ink remaining in the ink reservoirs 18 and 20. By examining the values sensed by the sensors 48 and 50, the printer electronics 27 can determine if a refill operation is needed. Likewise, examination of the sensors' 48 and 50 readings after a refill operation is performed will reveal whether or not the refill operation was successful.

Figures 4, 4A, 4B:
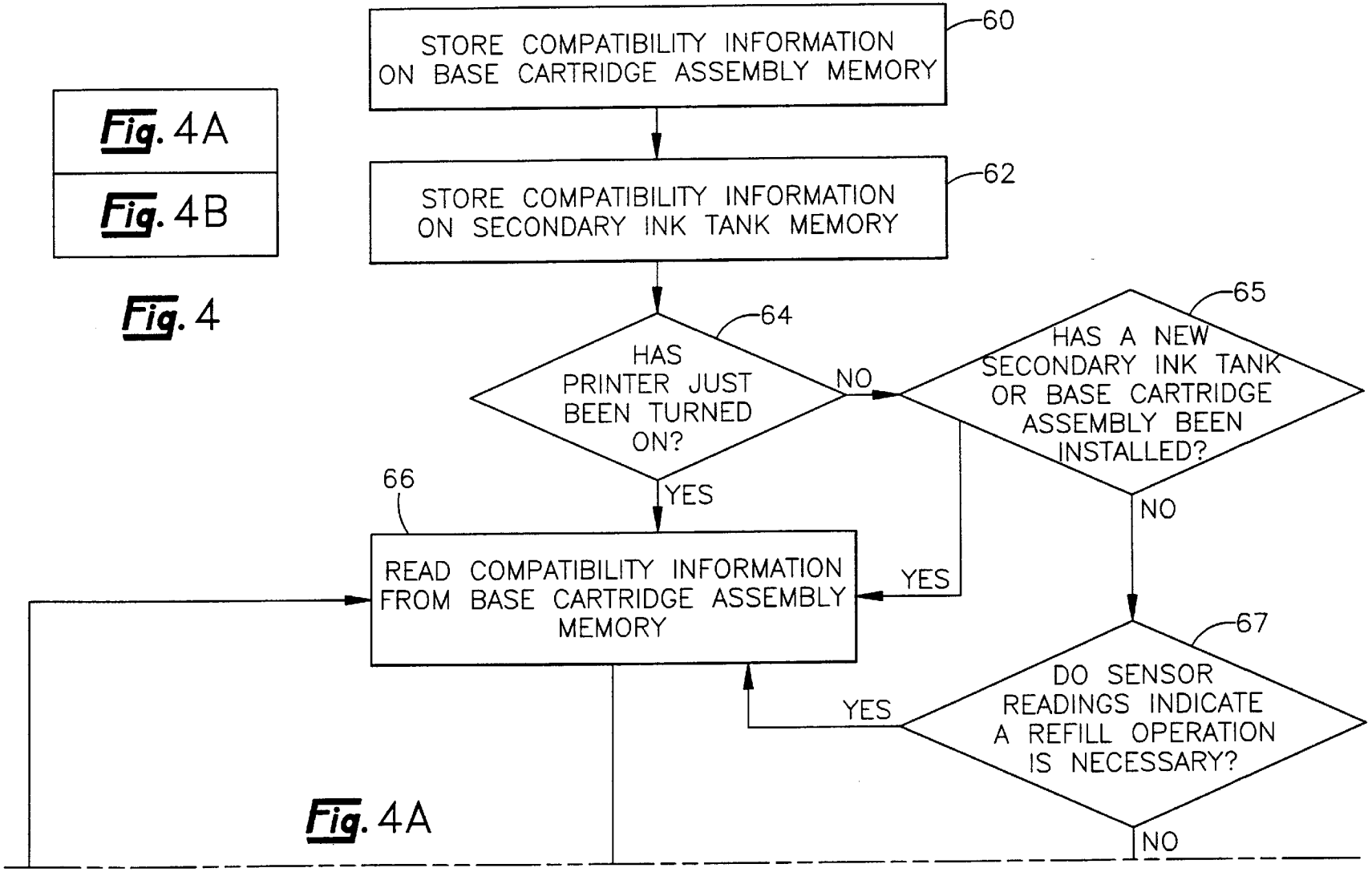
FIG. 4 includes FIGS. 4*a* and 4*b* which are a flow chart of the steps of a preferred method of preventing an incompatible secondary ink supply from mixing with a primary ink supply.
Figure 4B:
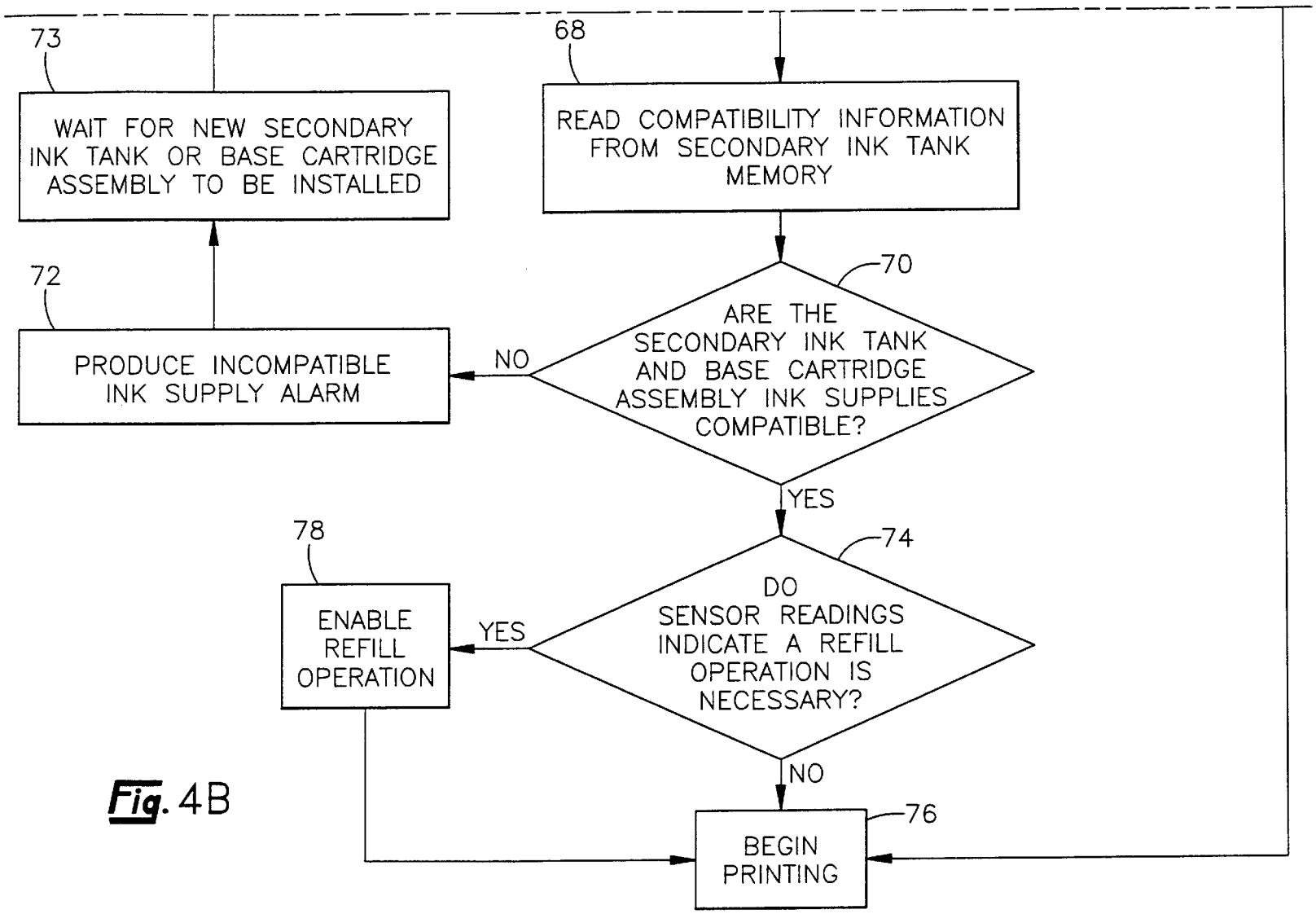

Turning now to FIGS. 4*a* and 4*b*, a flow chart of a preferred method of preventing incompatible secondary ink supplies in a secondary ink tank 12 from mixing with a primary ink supply in a base cartridge assembly 10 is shown. The first step of the method shown in block 60 involves storing compatibility information in a memory on the base cartridge assembly. Compatibility information is also stored in a memory on the secondary ink tank. This step is shown in block 62.

A number of occurrences require that the memories on the secondary ink tank and base cartridge assembly be checked to insure the primary and secondary ink supplies are compatible. As decisional block 64 reflects, one such occurrence is when the printer is first turned on. Because a new secondary ink tank or base cartridge assembly may have been installed when the printer was turned off, the ink supplies must be checked to insure they are compatible. In addition, the insertion of a new secondary ink tank or base cartridge assembly raises the possibility an incompatible ink supply has been introduced. This possibility is covered in decisional block 65. Finally, as a backup precaution, the ink supplies are checked for compatibility before any refill operation is initiated as shown in block 67. Checking to see if the ink supplies are compatible involves reading the compatibility information from the base cartridge assembly memory, block 66, reading the compatibility information from the secondary ink tank memory, block 68, and examining the compatibility information to determine if the ink supplies are compatible, block 70. Until it is determined that the ink supplies are compatible, the passages that allow the ink supplies to mix are blocked.

If the ink supply in the base cartridge assembly and the secondary ink tank are incompatible, an incompatible ink supply alarm is produced as shown in block 72 and the ink supplies are prevented from mixing. The method then waits for a new secondary ink tank or base cartridge assembly to be installed in block 73. Once a new secondary ink tank or base cartridge assembly is installed, the method returns to block 66 and proceeds to examine the compatibility information on the newly installed secondary ink tank or base cartridge assembly.

Once a secondary ink tank and a base cartridge reservoir with compatible ink supplies have been detected, the printer checks its sensors to determine if a refill operation is necessary as shown in block 74. If a refill operation is not necessary, the printer begins printing, block 76. If a refill operation is necessary, the method moves to block 78 and enables the refill operation before progressing to block 76.

Figures 5, 5A:
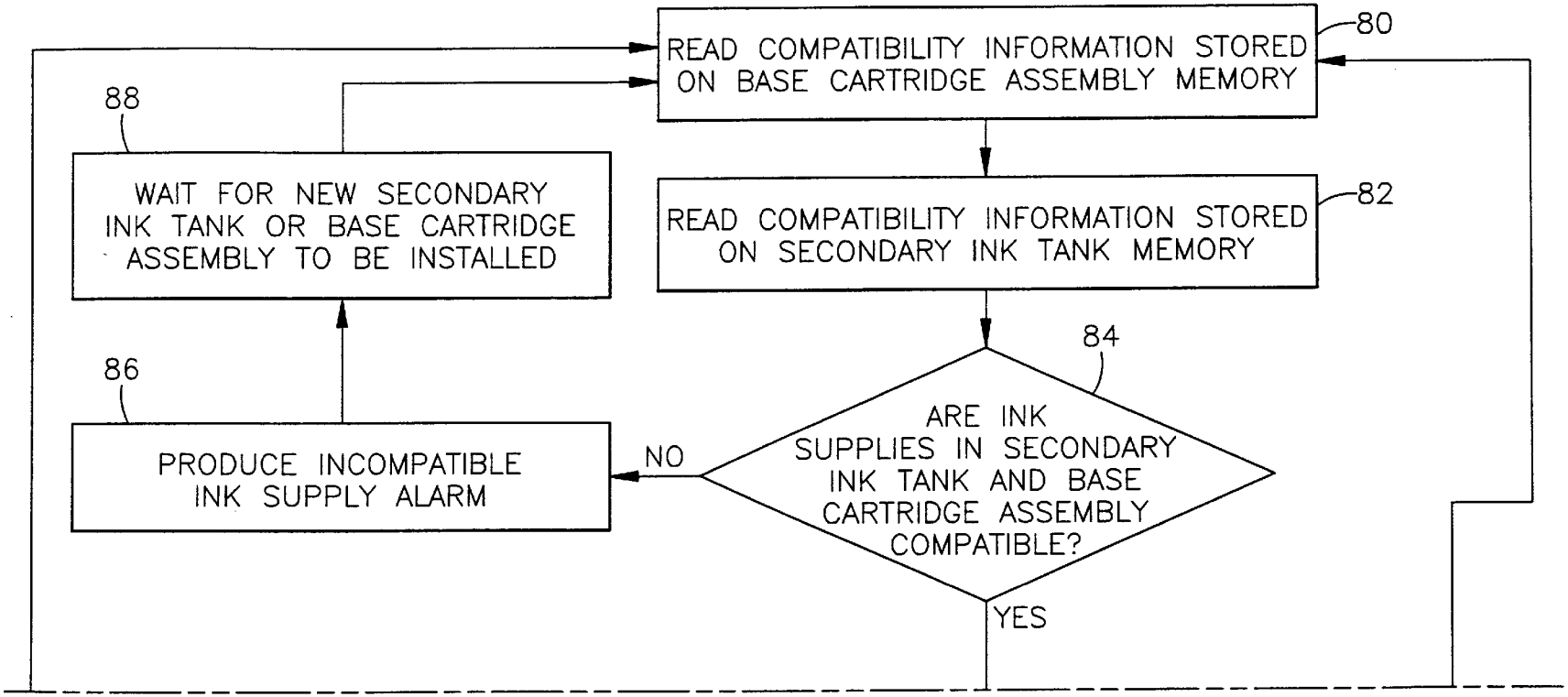
FIG. 5 includes FIGS. 5*a* and 5*b* which are a flow chart of the steps of a preferred method of insuring compatibility among secondary ink tank and base cartridge assembly pairs in a printer having multiple pairs.
Figure 5B:
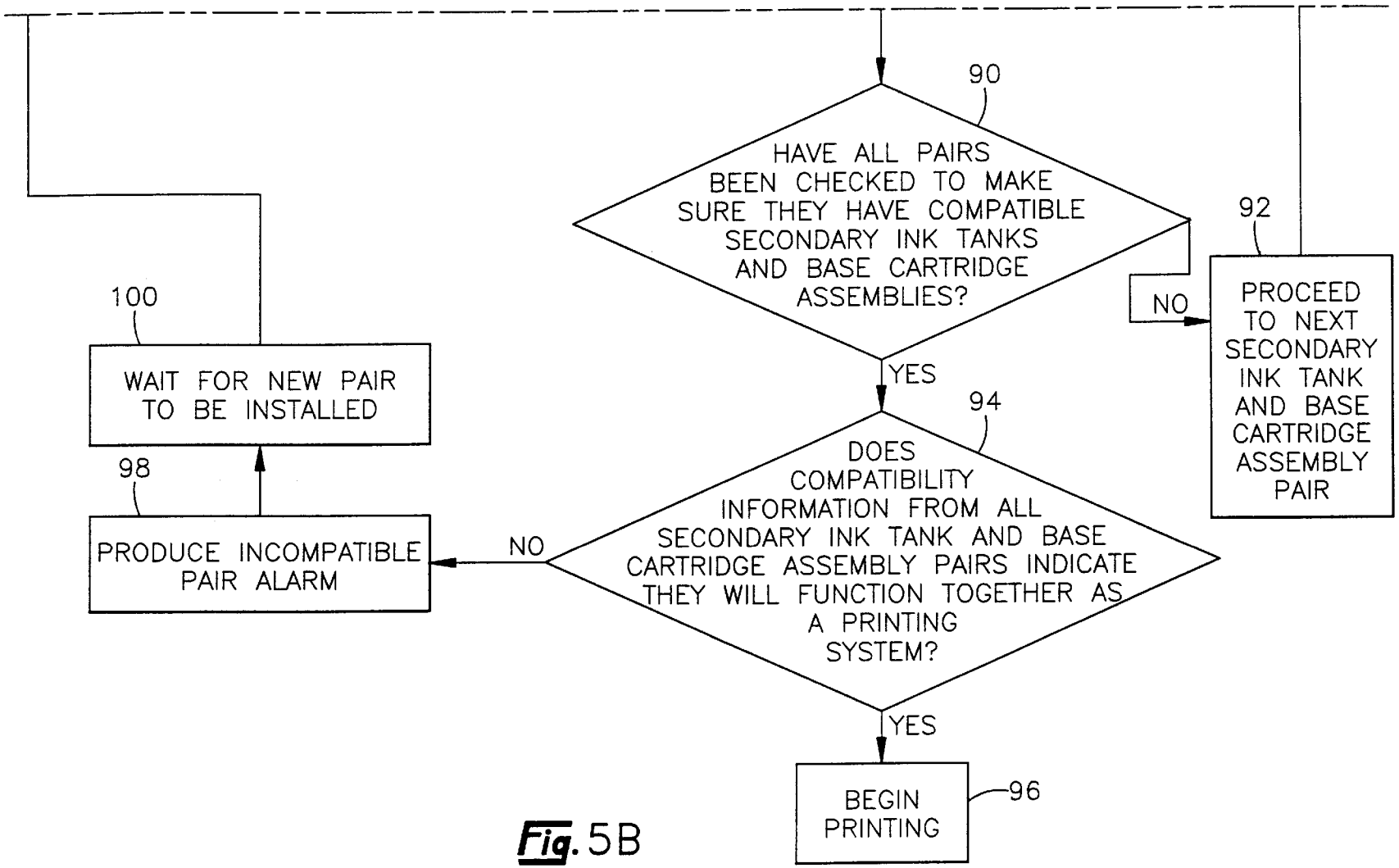

FIGS. 5*a* and 5*b* are a flow chart representation of a preferred method of insuring that the ink supplies in a printer having multiple secondary ink tank and base cartridge assembly pairs will work together as a printing system. For example, the dye and pigment formulation in a secondary ink tank and base cartridge assembly may be compatible with each other but, when mixed with the dye and pigment formulation of an adjoining secondary ink tank and base cartridge assembly pair, the desired effect may not be achieved. Color ink jet printers are an example of such a multiple print head printing system that requires the individual print heads to work together to produce an image.

In accordance with the method of FIGS. 5*a* and 5*b*, the compatibility information from the first base cartridge assembly and secondary ink tank pair is read as depicted in blocks 80 and 82. In decisional block 84, it is determined if the ink supplies in the secondary ink tank and base cartridge assembly are compatible. If they are not, an incompatible ink supply alarm is produced in block 86. The printer then waits for a new secondary ink tank or base cartridge assembly to be installed in the print head carrier as shown in block 88. Once a new installation is made, the method returns to block 80 to determine if the newly installed secondary ink tank and base cartridge assembly are compatible.

If the secondary ink tank and base cartridge assembly pair are compatible, a refill operation would be initiated if necessary. After refilling the base cartridge assembly, the method would proceed to block 90 and determine if all the pairs of secondary ink tanks and base cartridge assemblies have been checked for compatibility. If they have not, the method proceeds to the next pair, block 92, and checks that pair for compatibility. If all the pairs have been checked and are compatible, the method proceeds to decisional block 94 where the compatibility information is examined to determine if all the pairs will properly function together as a printing system. If they will work together, the method ends in block 96 and the printing operation commences. If it is determined that the pairs will not function properly, the printer produces an incompatible pair alarm as shown in block 98. The printer then waits for a new pair to be installed, block 100. Once a new pair has been installed the method falls back to block 80 and begins to check the newly installed pair for compatibility. In the alternative, all the pairs of secondary ink tanks and base cartridge assemblies are checked for compatibility before any refill operation is begun.

Figure 6:
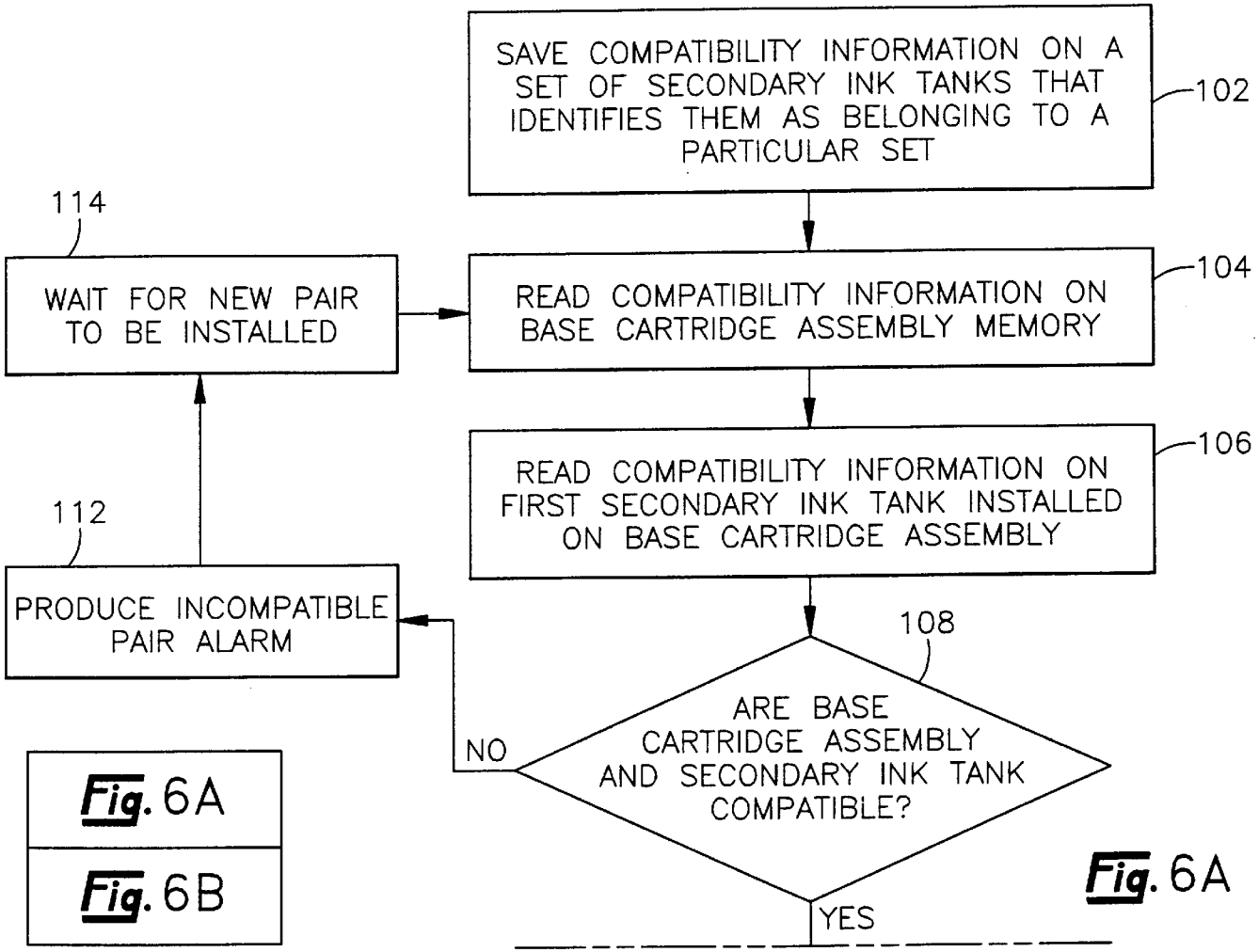
FIG. 6 includes FIGS. 6*a* and 6*b* which are a flow chart of a method of limiting a base cartridge to use with particular set of secondary ink tanks.
Figure 6B:
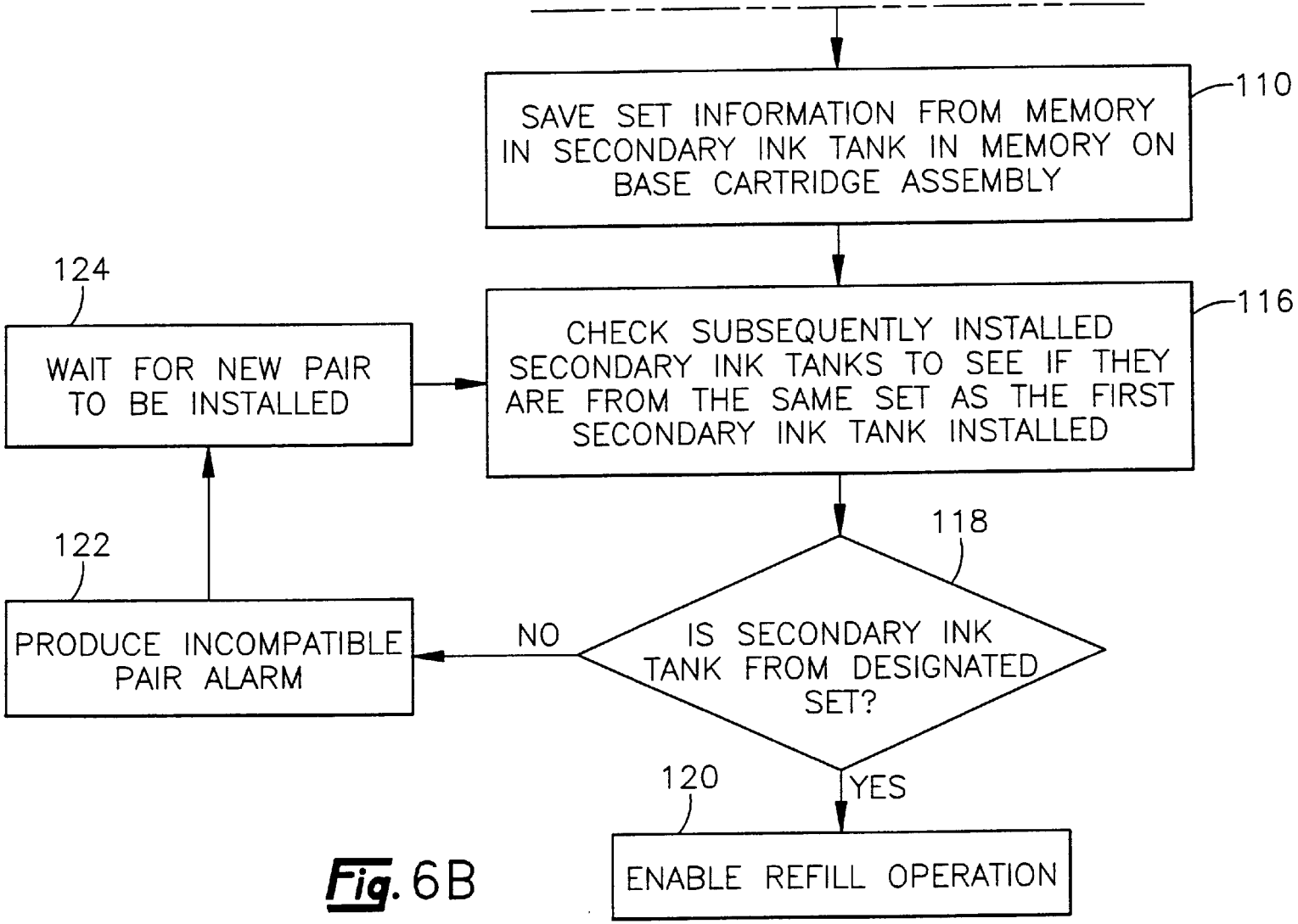

FIGS. 6*a* and 6*b* are a flow chart representation of a method for limiting a base cartridge assembly to being refilled by secondary ink tanks from a particular set of secondary ink tanks. The first step of the method, block 102, involves saving compatibility information on a set of secondary ink tanks that identifies the secondary ink tanks as belonging to a particular set of secondary ink tanks. This is preferably done during manufacture of the secondary ink tanks. Once a base cartridge assembly and secondary ink tank are installed on the print head carrier, the printer reads the compatibility information from the base cartridge assembly as shown in block 104. Next, the compatibility information from the secondary tank installed on the base cartridge assembly is read and it is determined whether or not the secondary ink tank and base cartridge assembly are compatible, blocks 106 and 108.

If it is determined that the secondary ink tank and base cartridge assembly are not compatible, an incompatible ink supply alarm prompts the user to install a new base cartridge assembly or secondary ink tank as shown in block 112. The printer then waits for a new installation, block 114. When a new secondary ink tank or base cartridge assembly is installed, the method returns to block 104 and once more checks for compatibility.

If it is determined that the secondary ink tank and the base cartridge assembly are compatible, the method proceeds to block 110 wherein the set information from the secondary ink tank is saved in the memory of the base cartridge assembly. Once the set information has been saved on a base cartridge assembly memory, the printer will examine any secondary ink tanks subsequently installed on the base cartridge assembly to determine if they are from the set indicated by the set information stored on the base cartridge assembly, block 116. As shown in blocks 118, 120 and 122, the printer electronics will only permit the base cartridge assembly to be refilled by secondary ink tanks from the same set as the first secondary ink tank installed on the base cartridge assembly. If a secondary ink tank from another set is installed on the base cartridge assembly, an alarm is produced to inform the user to install another secondary ink tank. As shown in block 124, the printer then waits for a new secondary ink tank to be installed before returning to the method at block 116.

Having described various aspects and embodiments of the invention and several advantages thereof, it will be recognized by those of ordinary skills that the invention is susceptible to various modifications, substitutions and revisions within the spirit and scope of the appended claims.

I claim:

1. A method of preventing an on carrier secondary ink tank from refilling an incompatible base cartridge assembly of an ink jet printer, the steps of the method comprising:

storing information concerning properties of a base cartridge assembly on a memory in the base cartridge assembly;

storing information concerning properties of the secondary ink tank on a memory in the secondary ink tank;

providing an electrical interface between the base cartridge assembly, secondary ink tank and printer electronics; and using the printer electronics to read the information from the base cartridge assembly and the secondary ink tank and determine if the base cartridge assembly and the secondary ink tank are compatible.

2. The method of claim 1 further comprising sending flow control signals from the printer electronics to flow control means, enabling the secondary ink tank to refill the base cartridge assembly if the information stored on the base cartridge assembly and secondary ink tank indicates the base cartridge assembly and the secondary ink tank are compatible.

3. The method of claim 1 further comprising:

storing an identification code on each secondary ink tank in a set of secondary ink tanks that identifies each secondary ink tank as belonging to the set of secondary ink tanks;

reading the identification code from a first secondary ink tank installed in a base cartridge assembly with the printer electronics and then storing the identification code in the memory on the base cartridge assembly; and only refilling the base cartridge assembly with ink from a secondary ink tank if the secondary ink tank has an identification code that matches the identification code stored in the memory of the base cartridge assembly and, thus, belongs to the same set of secondary ink tanks as the first secondary ink tank installed in the base cartridge assembly.

4. The method of claim 1 further comprising calculating the ink consumption of the base cartridge assembly and providing this information to the printer electronics through the electrical interface.

5. The method of claim 4 further comprising sensing the amount of ink remaining in the base cartridge assembly and providing this information to the printer electronics through the electrical interface.

6. The method of claim 5 further comprising comparing the calculated ink consumption of the base cartridge assembly to the sensed amount of ink remaining in the base cartridge assembly to determine if the base cartridge assembly has been refilled.

7. The method of claim 2 further comprising automatically disabling the flow of ink through the flow control means when printer power is off, when the base cartridge assembly is removed from the printer, or when the secondary ink tank is separated from the base cartridge assembly.

8. The method of claim 1 further comprising examining the electrical interface to determine if the secondary ink tank is properly installed on the base cartridge assembly.

9. The method of claim 1 further comprising examining the electrical interface and producing an incorrect installation signal if the examination of the electrical interface indicated either a short circuit or an open circuit.

10. The method of claim 1 further comprising using the printer electronics to control the flow of ink between the base cartridge assembly and the secondary ink tank by sending control signals to flow control means located between the base cartridge assembly and the secondary ink tank.

11. The method of claim 1 further comprising comparing the compatibility information from a first base cartridge assembly and secondary ink tank pair installed in a printer having multiple base cartridge assembly and secondary ink tank pairs to the compatibility information from at least one other base cartridge assembly and secondary ink tank pair to determine if the first base cartridge assembly and secondary ink tank pair will properly function with the other base cartridge and secondary ink tank pair as part of a printing system.

12. A method of preventing an on carrier secondary ink tank from refilling an incompatible base cartridge assembly for an ink jet printer, the steps of the method comprising:

storing compatibility information concerning properties of the secondary ink supply in a secondary ink tank in a memory on the secondary ink tank;

storing compatibility information concerning properties of the primary ink supply in a base cartridge assembly in a memory on the base cartridge assembly;

providing an electrical interface that allows communication of the compatibility information between the printer electronics, the base cartridge assembly and the secondary ink tank;

communicating the compatibility information from the base cartridge assembly and the secondary ink tank to the printer electronics through the electrical interface;

comparing and analyzing the compatibility information stored on the secondary ink tank with the compatibility information stored on the base cartridge assembly to determine if the secondary ink supply is compatible with the primary ink supply;

producing an incorrect installation alarm if the printer electronics determine that the electrical interface is either an open or a short circuit;

using the printer electronics to control the flow of ink between the base cartridge assembly and the secondary ink tank by sending control signals to flow control means located between the base cartridge assembly and the secondary ink tank;

producing an incompatible secondary ink supply alarm if the primary and secondary ink supplies are incompatible;

sending control signals from the printer electronics to the flow control means that enable the secondary ink tank to refill the base cartridge assembly if it has been determined that the primary and secondary ink supplies are compatible;

automatically preventing the flow of ink through the flow control means when the secondary ink tank and base cartridge assembly are separated; and sensing or calculating the ink consumption of the base cartridge assembly and providing this information to the printer electronics through the electrical interface.

13. The method of claim 12 further comprising:

storing an identification code on each secondary ink tank in a set of secondary ink tanks that identifies each secondary ink tank as belonging to the set of secondary ink tanks;

reading the identification code from a first secondary ink tank installed in a base cartridge assembly with the printer electronics and then storing the identification code in the memory on the base cartridge assembly; and only refilling the base cartridge assembly with ink from a secondary ink tank if the secondary ink tank has an identification code that matches the identification code stored in the memory of the base cartridge assembly and, thus, belongs to the same set of secondary ink tanks as the first secondary ink tank installed in the base cartridge assembly.

14. A device for insuring that a disposable on carrier secondary ink tank designed to be installed on a base cartridge assembly that has nozzles for expelling drops of ink is compatible with the base cartridge assembly for an ink jet printer, the device comprising:

a base ink reservoir located in the base cartridge assembly for containing a primary ink supply;

a secondary ink reservoir located in the secondary ink tank for containing a secondary ink supply;

a first memory located on the base cartridge assembly that contains compatibility information concerning properties of the primary ink supply;

a second memory located on the secondary ink tank that contains compatibility information concerning properties of the secondary ink supply;

an electrical interface for providing an electrical connection between a printer having printer electronics and the first and second memories that allows the printer electronics to read the compatibility information contained in the first and second memories; and flow control means controlled by the printer electronics for preventing the flow of ink from the secondary ink reservoir to the base ink reservoir if the printer electronics examine the compatibility information concerning the properties of the primary and secondary ink supplies and determine that the primary and secondary ink supplies are incompatible.

15. The device of claim 14 further comprising an ink supply passage for supplying ink from the secondary ink reservoir in the secondary ink tank to the base ink reservoir in the base cartridge assembly.

16. The device of claim 14 wherein the flow control means further comprise a pinch valve attached to a solenoid and wherein the solenoid is in electrical communication with the printer electronics in a manner that enables the printer electronics to control the flow of ink between the base ink reservoir containing the primary ink supply and the secondary ink reservoir containing the secondary ink supply.

17. The device of claim 14 further comprising an air receiving passage that provides a path for air to flow from the base ink reservoir containing the primary ink supply into the secondary ink reservoir containing the secondary ink supply.

18. The device of claim 14 further comprising an ink level sensor for sensing the amount of ink contained in the secondary ink reservoir.

19. The device of claim 14 further comprising a ink level sensor located in the base cartridge assembly for sensing the amount of ink contained in the base ink reservoir.

20. The device of claim 14 wherein the printer electronics determine an amount of ink expelled from the base cartridge assembly by counting the number of ink drops expelled by the nozzles on the base cartridge assembly.

21. The device of claim 20 wherein information representing the amount of ink expelled from the base cartridge assembly is saved in the first memory.

22. The device of claim 21 wherein the first memory located in the base cartridge assembly further comprises a non-volatile random access memory.

23. The device of claim 14 wherein the first memory located in the base cartridge assembly further comprises a non-volatile random access memory.

24. The device of claim 14 wherein the second memory located in the secondary ink tank further comprises a non-volatile random access memory.

25. The device of claim 24 wherein the nonvolatile random access memory located in the secondary ink tank is used to hold ink consumption information concerning an amount of ink dispensed from the secondary ink reservoir to the base ink reservoir.

26. The device of claim 23 wherein the non-volatile random access memory located in the base cartridge assembly stores ink level readings received from an ink level sensor located in the base ink reservoir and ink level values calculated from counting the number of drops of ink expelled from the nozzles.

27. The device of claim 26 wherein the ink level readings from the ink level sensor are compared to the ink level values calculated from counting the number of drops expelled to determine if the base ink reservoir has been refilled.

28. The device of claim 27 further comprising a microprocessor for performing calculations and comparisons.

29. The device of claim 14 further comprising processing means for evaluating the compatibility information stored on the first and second memory.

30. The device of claim 29 wherein the processing means is a microprocessor.

31. A print head cartridge system for an ink jet printer, the print head cartridge system comprising:

a base cartridge assembly wherein the base cartridge assembly comprises:

a base ink reservoir for storing a primary ink supply;

a heater chip containing a series of nozzles for expelling drops of ink from the primary ink supply onto a printing surface;

a stand pipe for providing ink from the base ink reservoir to the series of nozzles on the heater chip;

an ink receiving passage for receiving ink from a secondary ink tank mounted on the base cartridge assembly and providing the ink to the base ink reservoir;

an air supply passage that provides a path for air to flow from the base ink reservoir into the secondary ink reservoir;

a pinch valve attached to a solenoid for blocking the ink receiving passage and the air supply passage so that no ink can flow between the base cartridge assembly and the secondary ink tank when the solenoid engages the pinch valve;

a base cartridge assembly memory for storing information concerning properties of the primary ink supply in the base ink reservoir;

a sensor for sensing the amount of ink remaining in the base ink reservoir; and processing means for calculating the amount of ink expelled from the base ink reservoir;

a secondary ink tank designed to be mounted on the base cartridge assembly wherein the secondary ink tank comprises:

a secondary ink reservoir for containing a secondary ink supply;

an ink supply passage for providing ink from the secondary ink reservoir to the base ink reservoir located on the base cartridge assembly;

a memory for storing information concerning the secondary ink supply in the secondary ink reservoir;

an air receiving passage that provides a path for air to flow from the base cartridge assembly into the secondary ink tank; and an electrical interface between the base cartridge assembly, secondary ink tank and ink jet printer that enables the ink jet printer to control the functioning of the pinch valve and access the information stored in the memories of the base cartridge assembly and the secondary ink tank.

* * * * *